US007134256B2

(12) United States Patent
Kujubu et al.

(10) Patent No.: US 7,134,256 B2
(45) Date of Patent: Nov. 14, 2006

(54) PACKAGING SYSTEM

(75) Inventors: Eitaro Kujubu, Mihara (JP); Hiroshi Kondo, Mihara (JP); Wataru Kudo, Mihara (JP)

(73) Assignee: Furukawa Mfg. Co., Ltd. (JP)

( * ) Notice: Subject to any disclaimer, the term of this patent is extended or adjusted under 35 U.S.C. 154(b) by 0 days.

(21) Appl. No.: 10/902,463

(22) Filed: Jul. 29, 2004

(65) Prior Publication Data

US 2005/0022467 A1 Feb. 3, 2005

(30) Foreign Application Priority Data

Aug. 1, 2003 (JP) ..... 2003-284614

(51) Int. Cl.
*B65B 57/04* (2006.01)
*B65B 39/02* (2006.01)

(52) U.S. Cl. ..... 53/67; 53/64; 53/255; 53/260; 53/386.1

(58) Field of Classification Search ..... 53/64, 53/67, 255, 258, 260, 261, 385.1, 386.1, 53/284.7, 384.1
See application file for complete search history.

(56) References Cited

U.S. PATENT DOCUMENTS 3,503,180 A * 3/1970 Myles et al. ..... 53/258
3,552,090 A 1/1971 Roberts et al. ..... 53/71
3,750,721 A * 8/1973 Hudson ..... 141/10
3,774,367 A * 11/1973 Lerner ..... 53/67
3,778,972 A * 12/1973 Chlipalski ..... 53/531
3,942,416 A * 3/1976 Ackley et al. ..... 493/244
3,971,191 A * 7/1976 Hoyland ..... 53/512
4,028,775 A * 6/1977 Tysver ..... 452/39
4,177,621 A * 12/1979 Powell, Jr. ..... 53/468
4,241,562 A * 12/1980 Meyer ..... 53/438
4,370,845 A * 2/1983 Perolls et al. ..... 53/572
4,419,854 A 12/1983 Okada et al. ..... 53/434
4,754,596 A * 7/1988 Yasumune et al. ..... 53/434
5,056,299 A * 10/1991 Furukawa et al. ..... 53/571
5,473,869 A * 12/1995 Chikatani ..... 53/570
5,483,786 A 1/1996 Giesbrecht et al. ..... 53/570
5,692,360 A 12/1997 McDonald et al. ..... 53/434
5,987,854 A * 11/1999 Killinger et al. ..... 53/459
6,516,587 B1 * 2/2003 Chikatani ..... 53/459

(Continued)

FOREIGN PATENT DOCUMENTS

JP 49-72082 7/1974

(Continued)

*Primary Examiner*—Scott A. Smith
*Assistant Examiner*—Gloria R. Weeks
(74) *Attorney, Agent, or Firm*—Kusner & Jaffe

(57) ABSTRACT

The present invention provides a packaging system that includes a beak-shaped hopper, a pair of opening and closing bars, and a sensor for sensing a limitless opening and closing movement of the opening and closing bars. The beak-shaped hopper and the pair of opening and closing bars are operable to move in unison back and forth along a main travel path. The main travel path leads to a rotary vacuum packaging device having a pressure resistant chamber. The beak-shaped hopper is dimensioned to convey packaging bags into the pressure resistant chamber. The opening and closing bars are dimensioned to detect a bag on the hopper by opening towards both sides immediately after a bag has been conveyed into the pressure resistant chamber. A pushing bar is dimensioned to convey an item to be packaged into the bag when the bag is detected on the hopper by the opening and closing bars. The opening and closing bars contact a sensor for detecting movement of the opening and closing bars when a bag is not on the hopper.

8 Claims, 11 Drawing Sheets

U.S. PATENT DOCUMENTS

| | | | | |
|---|---|---|---|---|
| 6,584,753 | B1 * | 7/2003 | Dharssi et al. | 53/415 |
| 6,834,472 | B1 * | 12/2004 | Kujubu et al. | 53/64 |
| 6,868,655 | B1 * | 3/2005 | Gates et al. | 53/571 |
| 6,895,726 | B1 * | 5/2005 | Pinto et al. | 53/384.1 |
| 2002/0014054 | A1 | 2/2002 | Dharssi et al. | 53/415 |
| 2004/0035087 | A1 | 2/2004 | Kujubu et al. | 53/257 |
| 2005/0229547 | A1 * | 10/2005 | Koke | 53/468 |

FOREIGN PATENT DOCUMENTS

| | | |
|---|---|---|
| JP | 57-37525 | 3/1982 |
| JP | 58-203827 | 11/1983 |
| JP | 59-163121 | 9/1984 |
| JP | 10-81310 | 3/1998 |

* cited by examiner

FIG. 14

| | | | | |
|---|---|---|---|---|
| (15) BEAK-SHAPED HOPPER | S1 STANDBY | S3 S4 ADVANCE (TAKE UP BAG) | S5 HALT | S11 WITHDRAW |
| (47) OPENING AND CLOSING BARS | S1 STANDBY | S3 ADVANCE | S5 HALT<br>S8 PRIMARY OPENING CONFIRMATION<br>S14 SECONDARY OPENING TENSIONING | S13 WITHDRAW |
| (21) PUSHING BAR | S2 REPLENISH | S6 FOLLOW | S7 HALT<br>S9 CONVEY ITEM TO BE PACKAGED INTO BAG<br>S15 WITHDRAW WITHOUT CONVEYING ITEM | S10 WITHDRAW |

PACKAGING SYSTEM

FIELD OF THE INVENTION

The present invention relates to a packaging system for supplying bags for accommodating therein items to be packaged, to respective pressure resistant chambers provided with a rotary type vacuum packaging apparatus, in such a manner that they match the circulation pitch of the pressure resistant chambers.

BACKGROUND OF THE INVENTION

JP10-81310A describes a system in which a band-shaped film is formed into a tube-shape which surrounds the circumference of respective blocks of meat which move along a linear travel path, at equidistant intervals. The tube film into which a respective block of meat has been packaged is cut successively and separated, and each individual packaging bag containing a block of meat is supplied successively to a pressure resistant chamber of a rotary vacuum packaging device, by means of a belt conveyor. By means of this system, since a control is provided which causes the interval between the respective blocks of meat having an indefinite shape contained inside the bags to correspond to the pitch of the pressure resistant chambers which rotate at equidistant intervals, each block of meat can be disposed along the sealing platform of a pressure resistant chamber, whereas since differences in length occur respectively in the blocks of meat of indefinite shapes, a space may occur within each bag.

Furthermore, JP57-37525A discloses vacuum packaging technology, in which the end of a long tubular film which has already been formed to a shape is opened up, and an item to be packaged is pushed inside the tubular film via the open section. An operation is repeated wherein after the item to be packaged has been pushed inside the tubular film, the tubular film is cut, and the cut packaged bodies are then inserted successively into a pressure resistant chamber, and either end of the packaged body is heat sealed by means of a sealing bar under vacuum conditions. However, with a vacuum packaging device of this kind, too, excessive space occurs inside the bags when packaged objects are of indefinite shapes.

In contrast to the commonly known examples described above, JP49-72082A, JP58-203827A, and the like disclose technology in which the uppermost bag of stacked bags is opened up by air pressure, an item to be packaged is introduced into the bag via the opening thereof, and is then conveyed together with the bag. By using this technology, it is thought to be possible to convey blocks of meat inside bags in a fitted manner along the sealing platform of a vacuum chamber. However, a distortion or slack is caused to occur at the mouth of the bag during transportation, which impairs the vacuum sealing properties of the packaged body. If such distortion or slack of the bag is removed while the bag is on the sealing platform, the efficiency of the rotary vacuum packaging device is adversely affected.

SUMMARY OF THE INVENTION

The present invention discloses a system for supplying items to be packaged of indefinite shapes into bags, and each respective bag is conveyed into a respective pressure resistant chamber of a rotary vacuum packaging device, and it also discloses that the system includes means for holding the mouths of the bags in a tense state during operation, as well as for confirming the supply of bags and identifying bag opening errors in an unmanned fashion.

More specifically, the present invention comprises: means for causing a beak-shaped hopper, formed by a pair of upper and lower groove-shaped members, and a pair of opening and closing bars, to move back and forth in unison along a main travel path leading to a rotary vacuum packaging device; means for extending and supporting the opening section of the uppermost packaging bag of packaging bags stacked in the main travel path, and conveyance same to a pressure resistant chamber of the vacuum packaging device, by means of the back and forth movement of the beak-shaped hopper in the main travel path; means for causing a waiting station to move following the conveyance movement of the beak-shaped hopper into a pressure resistant chamber; means for detecting the resistance of the bag by opening the opening and closing bars towards either side immediately after the bag has been conveyed into the pressure resistant chamber; means for conveying an item to be packaged waiting on the waiting station, into the bag, via the beak-shaped hopper, by means of a pushing bar, if the resistance of a bag is detected in the opening and closing bars; and means for withdrawing the pushing bar, while leaving the item to be packaged on the waiting station, in a case where the resistance of a bag against the opening and closing bars is detected and the sensor has detected movement of the opening and closing bars.

The beak-shaped hopper, in unison with the opening and closing bars, moves back and forth along a main travel path in the direction of the vacuum packaging device, at a prescribed time cycle, in the company of a waiting station, and upon each forward movement, the beak-shaped hopper and the opening and closing bars extend a bag disposed in stacked fashion in the main travel path and convey it into the pressure resistant chamber of the vacuum packaging device.

Immediately after this conveyance of the bag, the opening and closing bars perform a first opening operation, whereby they look for the resistance of the bag. If there has been a failure to pick up a bag on the main travel path, then no resistance of the bag will be produced on the opening and closing bars, and therefore the opening and closing bars will open in a limitless fashion and touch the sensors.

If the resistance of a bag does act on the opening and closing bars, then the pushing bar pushes the item to be packaged mounted on the waiting station, inside the bag in the pressure resistant chamber, via the beak-shaped hopper, and immediately thereupon, the pushing bar is returned to its original position, together with the beak-shaped hopper, leaving only the opening and closing bars behind. The opening and closing bars then open out for a second time, thereby tensioning the mouth of the bag, and with the mouth of the bag in this tensioned state, it is conveyed to a sealing platform by a pair of clamps. Therefore, when the mouth of the bag is heated and sealed by the sealing bars, in the rotary path of the pressure resistant chambers, a seal without any wrinkles is produced and hence the tight vacuum seal of the bag is preserved.

However, if there is no resistance of a bag on the opening and closing bars when they open for the first time, and the movement of the opening and closing bars is detected by the sensors, then this indicates that the bag has not opened up properly, or that there is no bag present, and hence the pushing bar is returned to its original position, together with both the beak-shaped hopper and the waiting station, without conveying the item to be packaged into the pressure resistant chamber. If the second opening movement of the opening and closing bars is detected by the sensors, then the entire device is halted, thereby allowing time to replenish the supply of bags, or to check the status of the bags provided.

BRIEF DESCRIPTION OF THE DRAWINGS

FIG. 14 is a descriptive diagram of the movement of the mechanism; and

DETAILED DESCRIPTION OF PREFERRED EMBODIMENT

Figure 1:
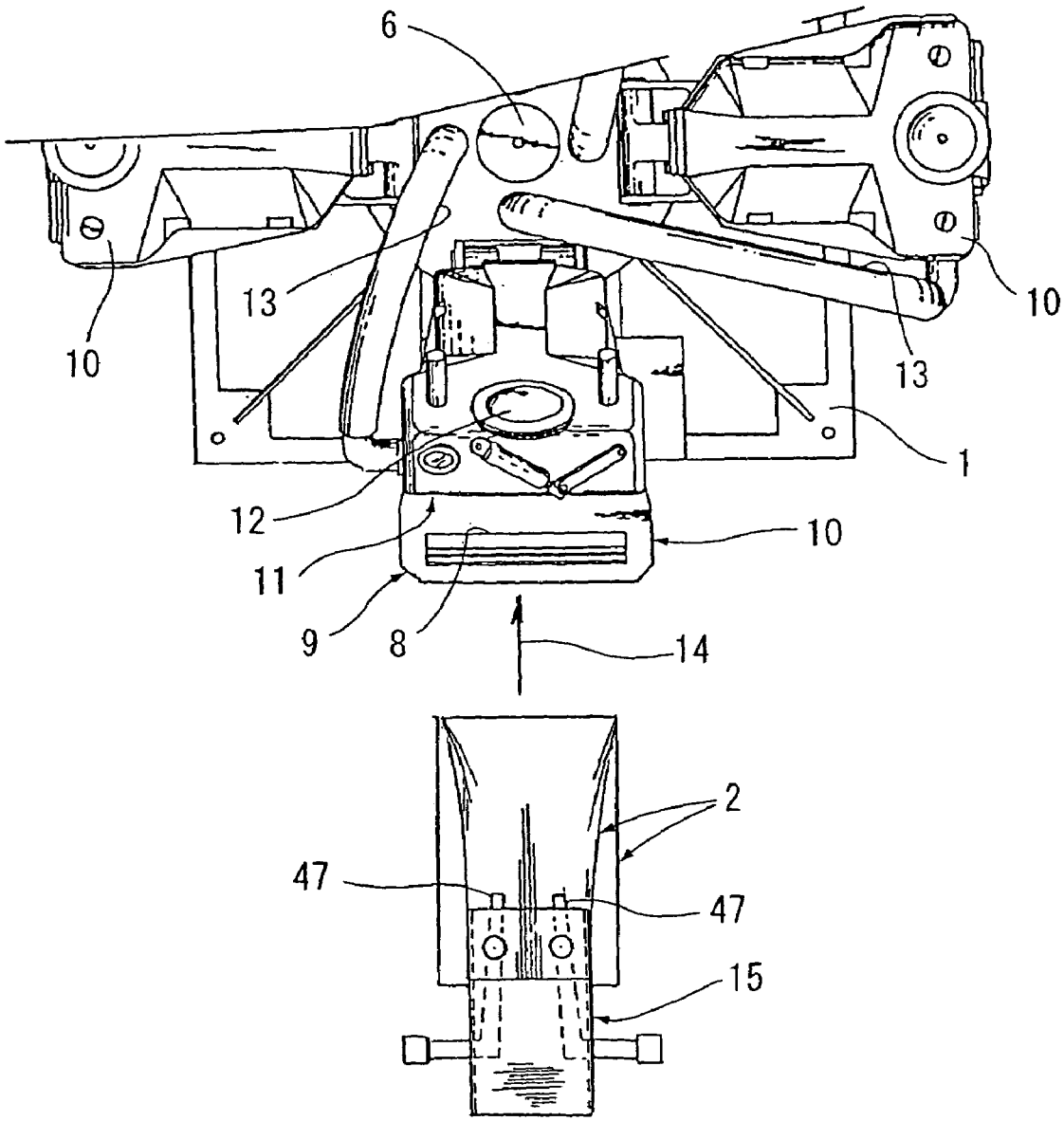
FIG. 1 is a partial plan view of a packaging system showing one portion of a vacuum packaging device.
Figure 2:
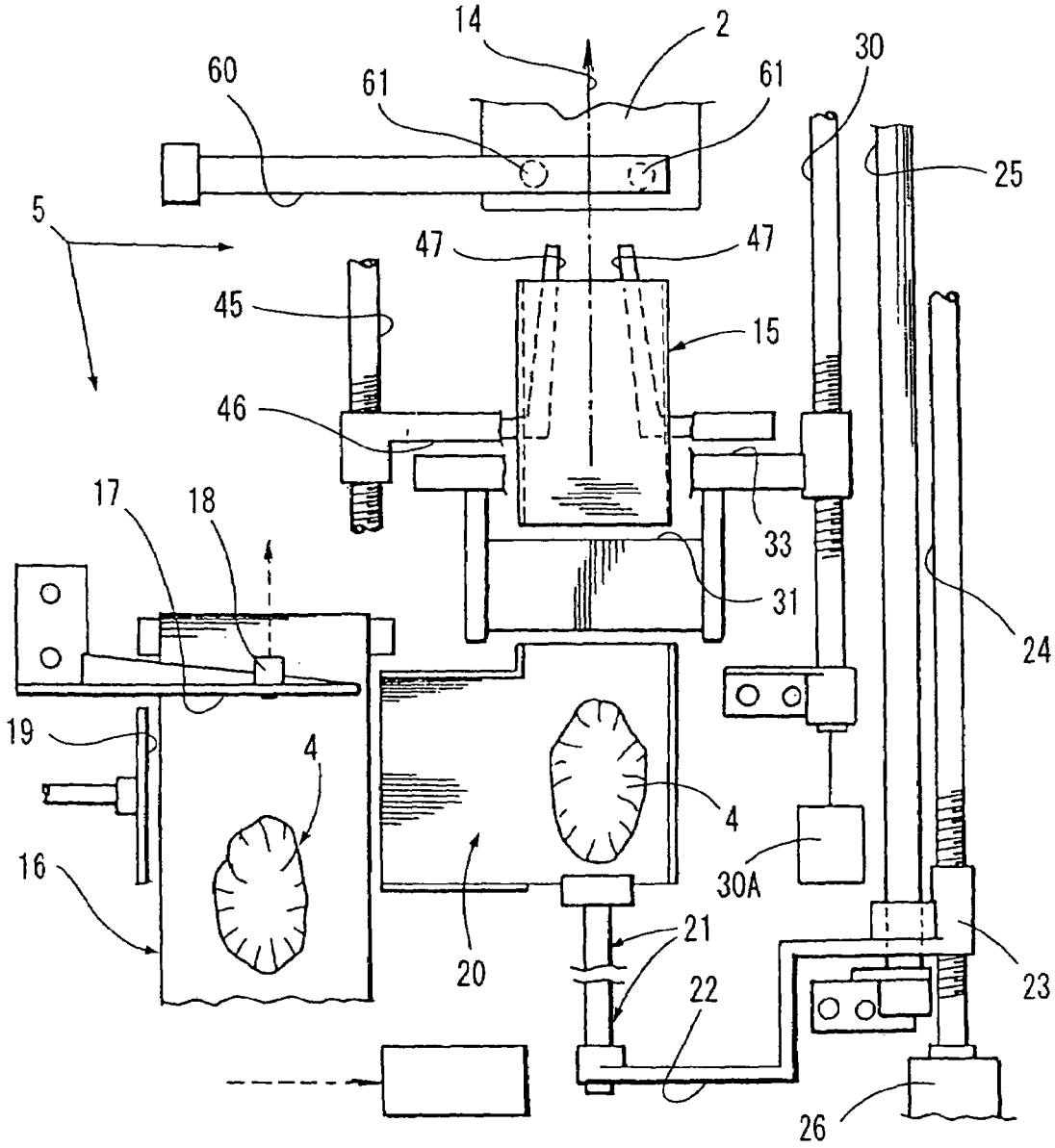
FIG. 2 is a plan view of a conveyance device in the packaging system.

FIG. 1 is a partial plan view of a rotary vacuum packaging device, and FIG. 2 is a plan view of a device for supplying an item to be packaged and a bag, to the vacuum packaging device. The packaging system which is illustrated in a separated fashion in these two diagrams comprises a rotary vacuum packaging device 1 which seals a bag containing an item to be packaged, under vacuum conditions, thereby creating a vacuum packaged product, and respective conveyance mechanisms 5 for supplying empty bags to the vacuum packaging device 1 and accommodating the items to be packaged 4 inside the bags 2.

In FIG. 1, the rotary vacuum packaging device 1 is shown in a partial fashion, due to considerations of space, but this vacuum packaging device 1 comprises four pressure resistant chambers 10 which are rotated intermittently, at positions 90° apart, by means of the driving force of a centrally positioned main axle 6. The respective pressure resistant chambers 10 are each equipped with a fixed plate 9 provided with a sealing platform 8 on the upper face thereof, and a lid member 11 disposed in an openable and closable fashion with respect to a fixed base 9, a sealing bar (not illustrated in the drawings) which is operated by means of a hydraulic fluid cylinder or a diaphragm 12 being provided inside each of the lid members 11.

A bag 2 supported by a beak-shaped hopper 15 is supplied onto the fixed base 9 from the direction indicated by arrow 14, which indicates the main travel path, whereupon an item to be packaged is inserted into the bag 2 from the rear side, via the same beak-shaped hopper 15. Thereupon, the pressure resistant chamber 10, with the lid member 11 closed, is rotated in a clockwise direction, during which the suction force of a vacuum pump (not illustrated) acts on the interior of the chamber, via a pipe 13, and under vacuum conditions, the open end of the bag is then heat sealed by the sealing bar, whereby vacuum packaged products are successively created.

As described previously, the conveyance mechanism 5 illustrated in FIG. 2 is a device for conveying a bag 2 and an item to be packaged 4 situated on a main travel path 14, onto the fixed base 9 of a pressure resistant chamber. More specifically, the device 5 comprises a belt conveyor 16 for conveying the item to be packaged 4, and a stopper 17 disposed on the end of this belt conveyor has the function of receiving and halting the movement of the item to be packaged 4. When the item to be packaged 4 makes contact with a proximity switch provided on the stopper 17, an element 19 transfers the item to be packaged 4 from the region of the belt conveyor 16 onto the starting station 20. Furthermore, a pushing bar 21 which borders the front end of the starting station 20 is supported on a first screw bar 24 and a guide rail 25, by means of an arm 22. By means of this first screw bar 24 turning in the forward or reverse directions, based on an electric motor 26 which forms the drive source thereof, the pushing bar 21 moves forwards or backwards along the main travel path 14. The first screw bar 24 has a screw groove formed along the whole length thereof. The inner face of the boss 23 which holds the arm 22 on the first screw bar 24 is formed with a female screw thread.

In FIG. 2, a second screw bar 30 disposed on the inner side of the first screw bar 24 in a parallel fashion with same causes a deck plate 31 forming a waiting station, and the beak-shaped hopper 15 described previously, to move back and forth in unison along the main travel path by means of forward or reverse rotation of an electric motor 30A. The backward and forward movement of the beak-shaped hopper 15 and the waiting station 31 coincides with the intermittent movement, through one pitch, of the respective pressure resistant chambers 10 shown in FIG. 1, and a structure is adopted whereby if a halt signal is issued to the vacuum packaging device 1 or to any of the first or second screw bars 24, 30, then each of these elements is respectively halted, in a simultaneous fashion.

Figure 3:
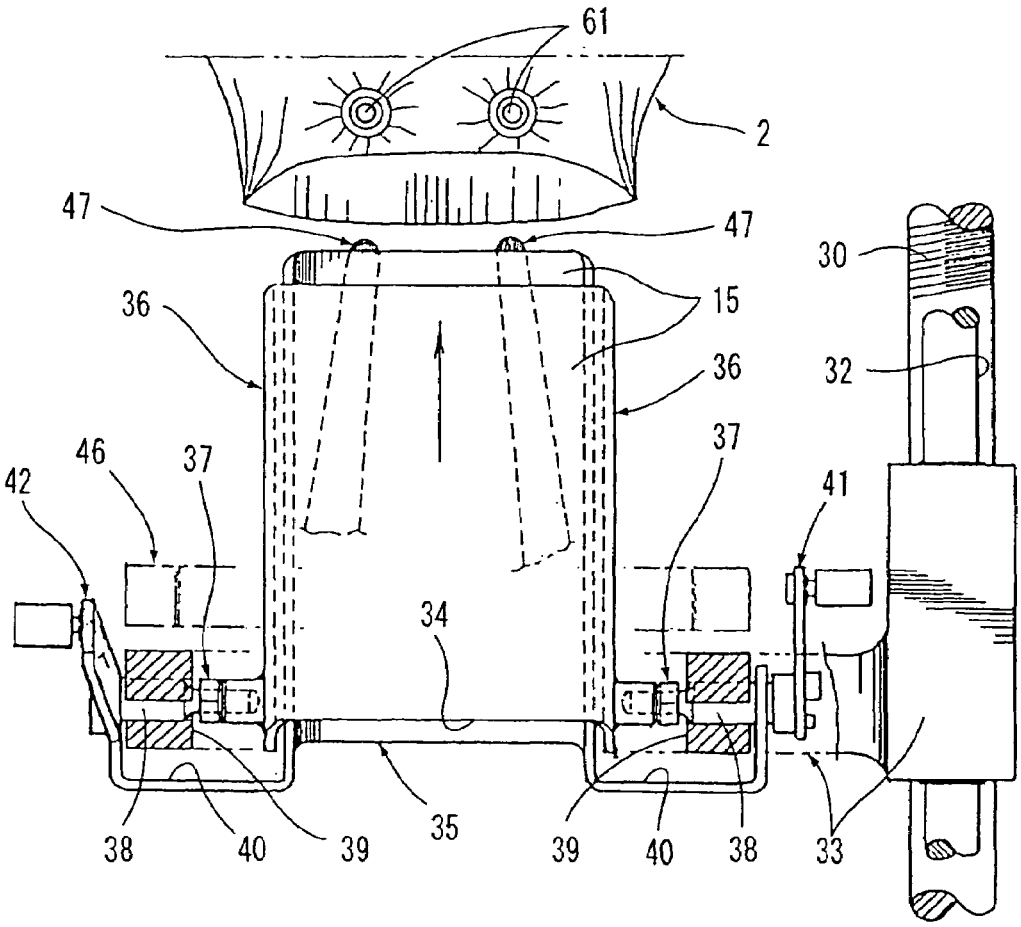
FIG. 3 is a plan view of a beak-shaped hopper.
Figure 4:
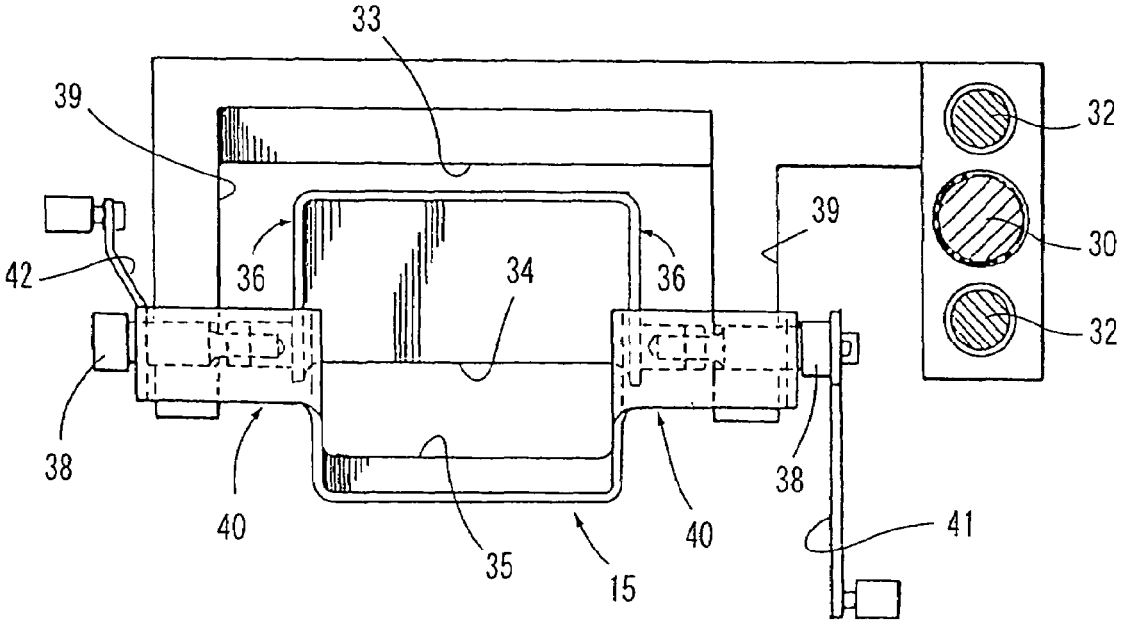
FIG. 4 is a rear face view of the beak-shaped hopper.

The plan view in FIG. 3 and the rear side view in FIG. 4 illustrate the structure of the beak-shaped hopper 15, wherein a frame 33 is supported slidably on the second screw bar 30 described previously, and the aforementioned upper and lower guide bars, 32, 32. The frame 33 supports two groove-shaped members 34, 35, disposed in upper and lower positions, which constitute the aforementioned beak-shaped hopper 15. A portion of the upper positioned groove-shaped member 34 which is of greater width covers the outer side of the lower positioned groove-shaped member 35. The two side faces 36 of the upper groove-shaped member 34 are composed in such a manner that they are supported rotatably on two suspended bars 39 provided on the frame 33, by means of pins 38 fixed respectively by fastening nuts 37. Moreover, supporting plates 40 extending respectively in a curved fashion from either side of the lower groove-shaped member 35 are supported rotatably on the respective pins 38. Furthermore, a lever 41 is fixed to the end of one of the pins 38, and another lever 42 is fixed to the supporting plate 40 on the other side. Therefore, if the pin 38 is rotated by means of force acting on the lever 41 on one side, then it is possible to move the front end of the upper groove-shaped member 34 fixed to this pin upwards and downwards, and if the lever 42 on the other side is operated, then it is possible to move the front end of the lower groove-shaped member 35 upwards and downwards. In summary, the beak-shaped hopper 15 can be opened and closed as desired.

As described previously, the frame 33 which engages with the second screw bar 30 in FIG. 2 is supported and moved in an integral fashion with the beak-shaped hopper 15 and the waiting station 31, by rotation of the screw bar 30, whereas the frame 46 supported on the third screw bar 45 on the opposite side supports a pair of opening and closing bars 47, and by forward or reverse rotation of this third screw bar 45, it is possible to displace the opening and closing bars 47 in an independent fashion. This structure is described below.

Figure 5:
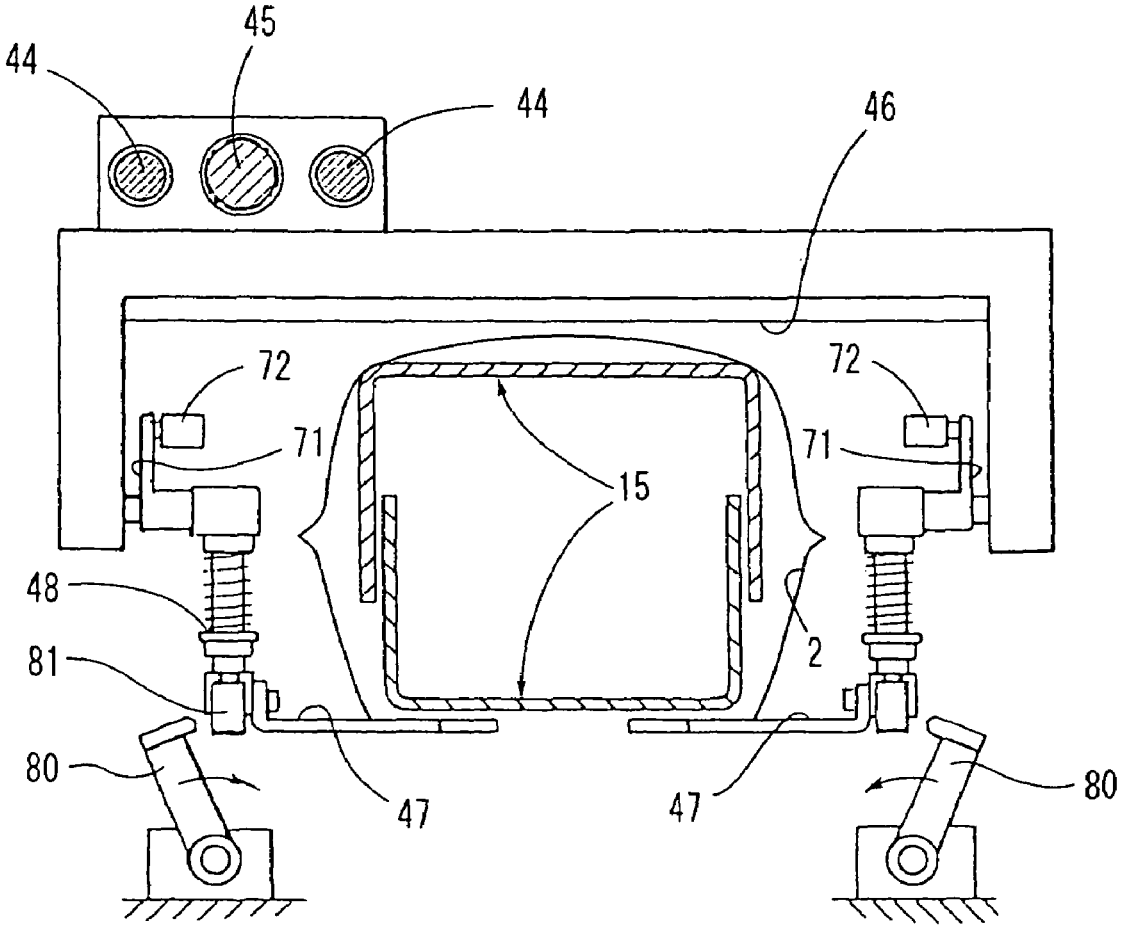
FIG. 5 is a rear face view of the beak-shaped hopper and opening and closing bars.
Figure 6:
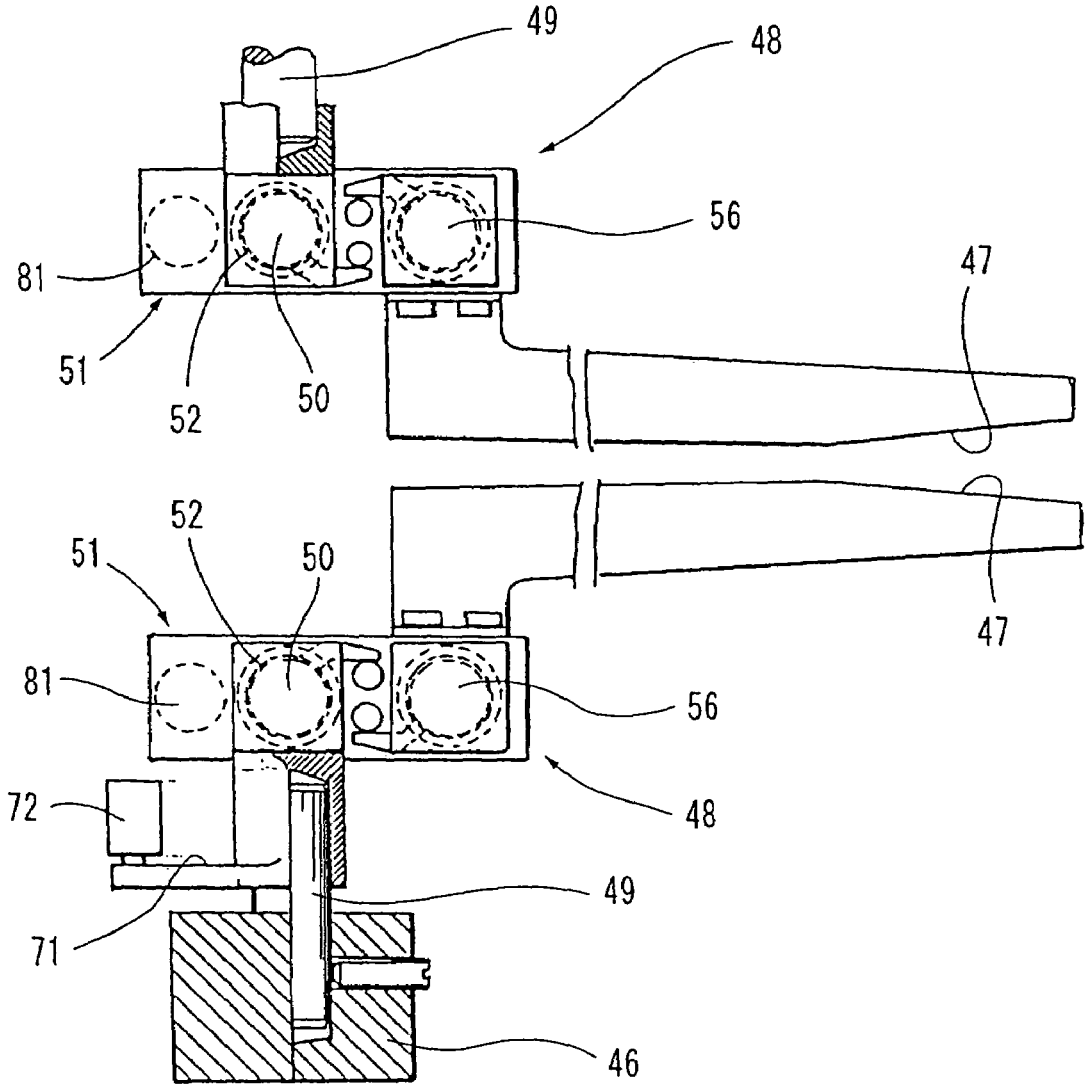
FIG. 6 is a plan view of the opening and closing bars.

More specifically, as shown in FIG. 5, frames 46 disposed so as to straddle the beak-shaped hopper 15 are supported on two guide bars 44 disposed mutually in parallel, and the third screw bar 45 described previously, and the aforementioned pair of opening and closing bars 47 are disposed on either end of the frames 46. Therefore, when the third screw bar 45 is rotated, the pair of opening and closing bars 47 moves in unison with the frames 46, independently of the beak-shaped hopper 15. As shown by the plan view in FIG. 6 and the side view in FIG. 7, a block 70 from which a core axle 50 is suspended is supported by each of a pair of horizontal pins 49, 49 projecting in a mutually opposing fashion from the inner side faces of the respective frames 46, and a long and narrow base section 51 is supported rotatably at the lower portion of each core axle 50, in addition to which a torsion coil spring is disposed about the core axle 50. The reactive force of the coil spring 52 acts against twisting of the base section 51 in the clockwise direction in FIG. 8, so as to return the base section 51 in the anti-clockwise direction, but this returning rotational force is restricted by causing a pin 54 provided in a standing fashion on the upper face of the base section 51 to abut against a stopper 55 which projects from the side face of the core axle 50. The forces imparted to the respective base sections 51 by the respective coil springs 52 of the two base sections 51 on either side in FIG. 6 act in mutually symmetrical directions.

Figure 7:
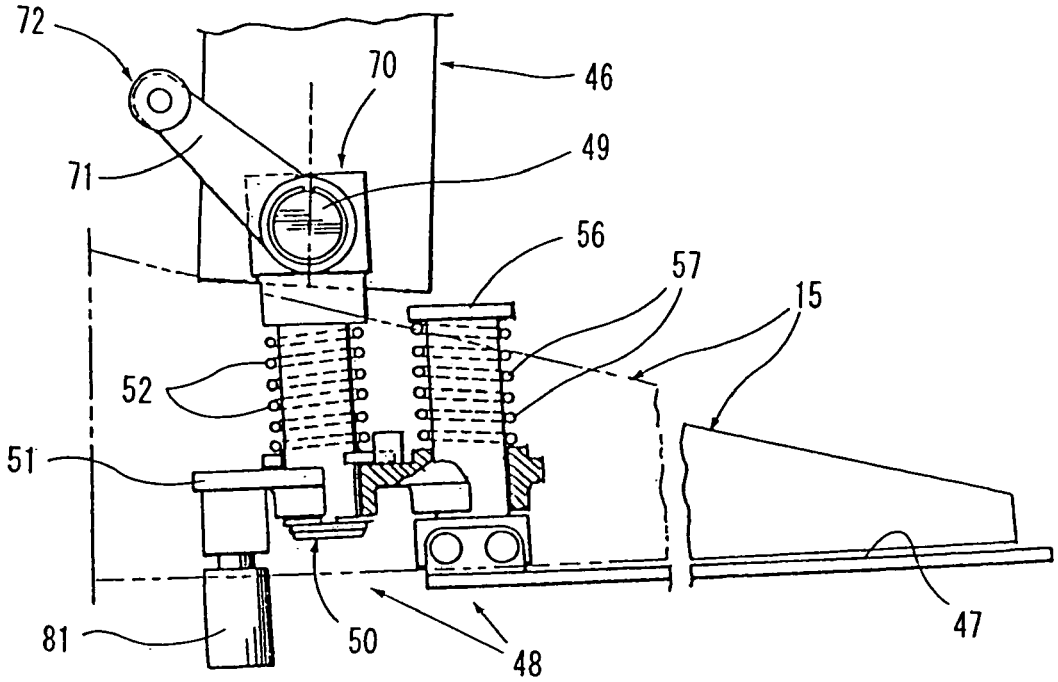
FIG. 7 is a side view of a shock-absorbing mechanism.

On the other hand, an axle 56 is supported rotatably on the front end of each base section 51, and an opening and closing bar 47 is provided on the lower end of this axle 56. In FIG. 7, a coil spring 57 wound about the axle 56 supported rotatably on each base section 51 acts so as to rotate the opening and closing bar 47 in the clockwise direction in FIG. 8, and this rotational force is restricted by means of a book 58 which projects from the axle 56 abutting against a stopper 59 which is provided in a standing fashion on the base section 51. Therefore, the respective opening and closing bars 47 on the pair of base sections 51 on either side open up the open edge of the bag 2, in the respective side direction, in a shock absorbing fashion, due to the elastic force of the respective coil springs 57.

Figure 9:
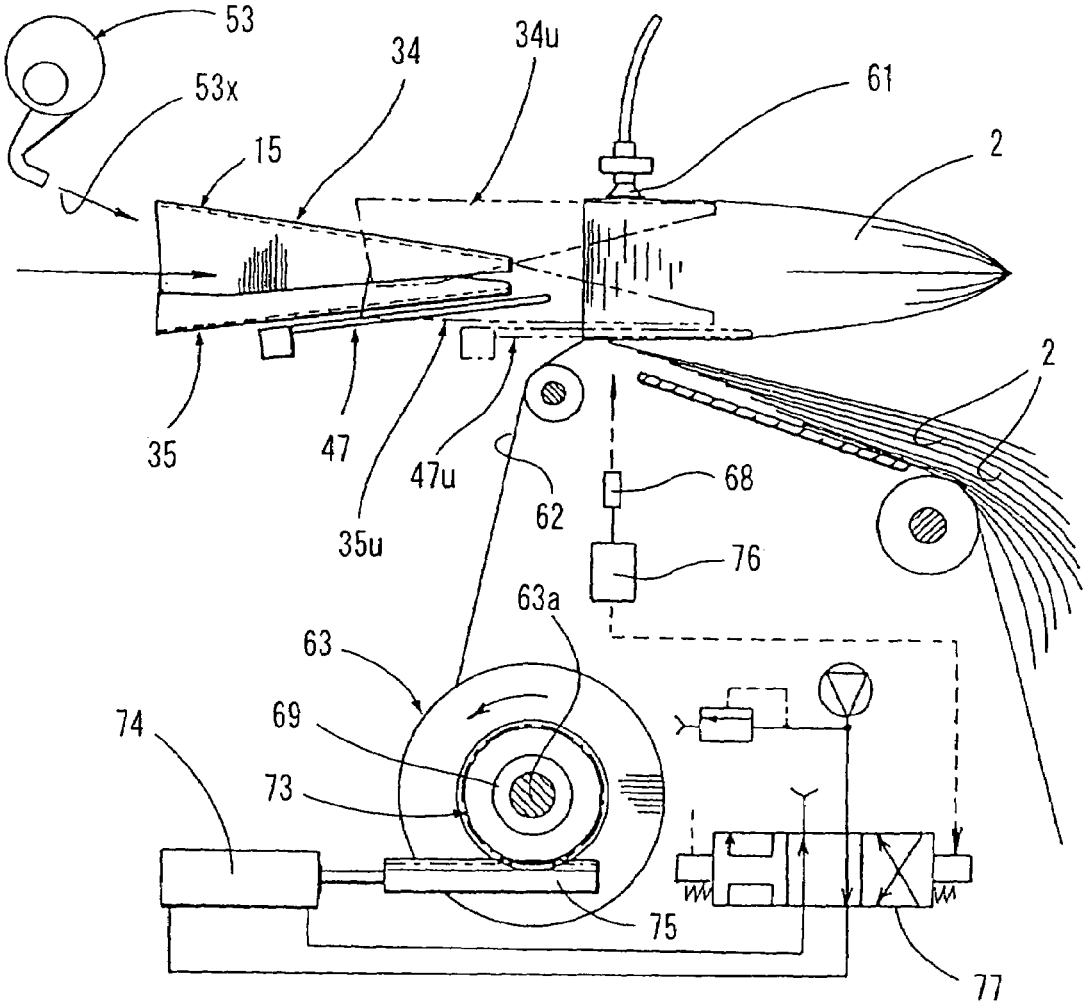
FIG. 9 is a descriptive diagram of the stacking of taped bags.
Figure 10:
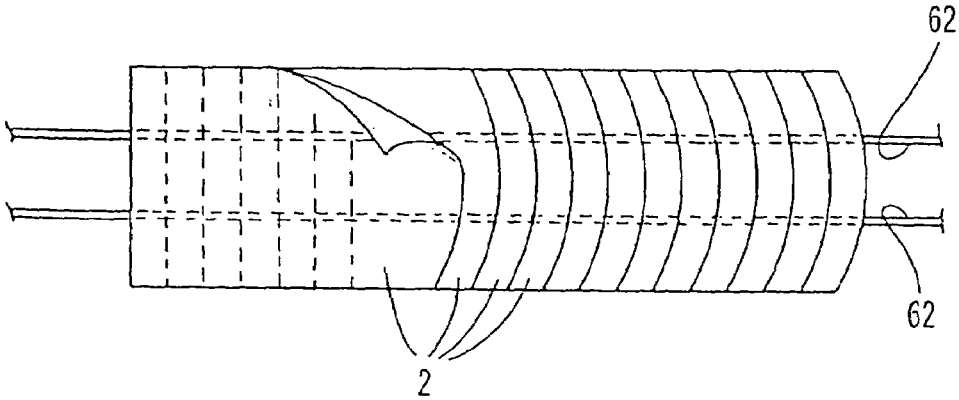
FIG. 10 is a plan view of the taped bags.

Raising and lowering arms 60 provided with two vacuum cups 61 on the lower face thereof are disposed in the main travel path 14 in FIG. 2, and bags 2 are disposed in a stacked fashion below same. FIG. 9 is a side view of a package stacking section, and in this section, as shown in FIG. 10, stacked bags are disposed in such a fashion that a plurality of bags 2 are attached, in the form of fish scales, to a suitable number of adhesive tapes 62. In FIG. 9, the bags 2 can be removed by winding the tape 62 about a reel 63. A composition is adopted whereby, when the mouth of the uppermost bag 2 suctioned up by the vacuum cup positioned above same is opened upwards, the advancing beak-shaped hopper 15 and the opening and closing bars 47 are introduced inside the bag 2.

As illustrated in FIG. 9, the beak-shaped hopper is introduced into the bag 2 in a state where the upper and lower groove-shaped members 34, 35 and the opening and closing bars 47 form a narrow front end, as indicated by the solid lines in the diagram, but thereafter, the front end is opened up as indicated by the dotted lines 34U, 35U and 47U, thereby extending the edges of the opening of the bag 2, and by means of further advancing movement, the bag 2 is peeled away from the adhesive tapes 62. In this case, an air blower 53 disposed above the main travel path blows air into the bag 2, via the internal cavity in the beak-shaped hopper 15, as indicated by the arrow 53X, and hence the bag 2 can be caused to expand, as shown in the diagram.

Figure 11:
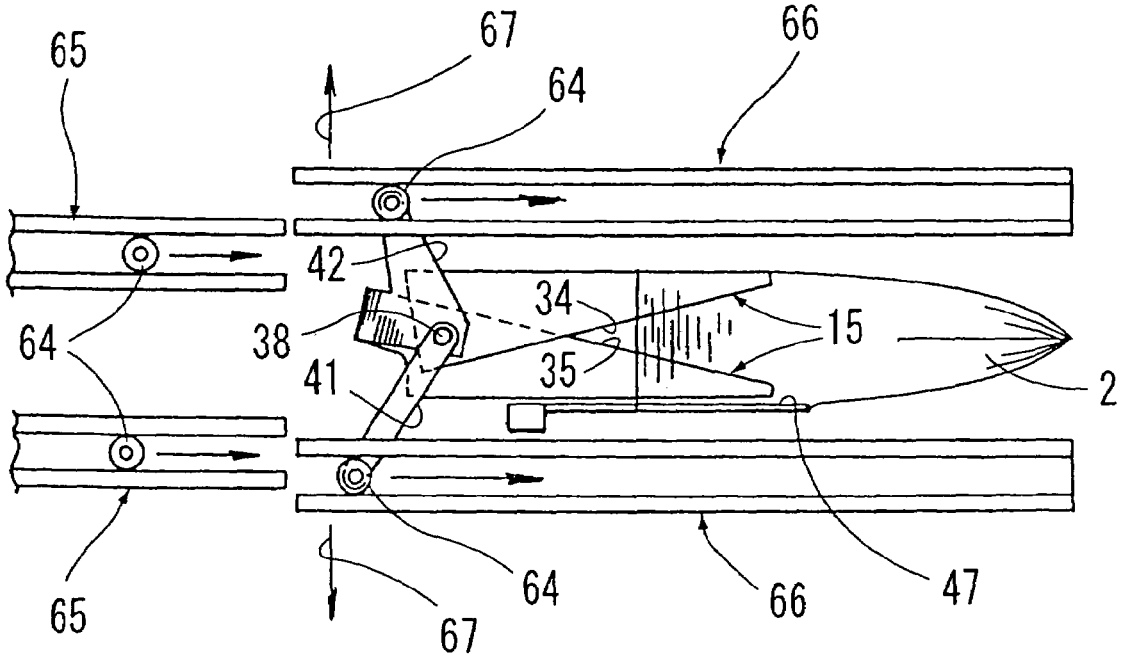
FIG. 11 is a descriptive diagram of a mechanism for opening and closing the beak-shaped hopper.

The edges of the opening of the bag 2 are extended by the beak-shaped hopper 15, as described above, by means of the following mechanism. More specifically, a set of two front side rails 65 in upper and lower positions, for guiding sliding wheels 64 attached to the respective levers 41, 42 of the upper and lower groove-shaped members 34, 35, and a similar set of two rear side rails 66 in upper and lower positions, are disposed in the main travel path, as illustrated in FIG. 11. Immediately after the upper and lower sliding wheels 64 traveling along the upper and lower front side rails 65 have respectively mounted onto the upper and lower rear side rails 66, the upper and lower rear side rails 66 are separated in the direction of the arrow 67, whereby the front ends of the upper and lower groove-shaped members 34, 35 are mutually separated, about the pins 38, and the edge of the opening of the bag 2 is extended. In this case, by means of the mechanism described below, the opening and closing bars 47 below the beak-shaped hopper are also moved in unison with the groove-shaped members 34, 35.

Figure 8:
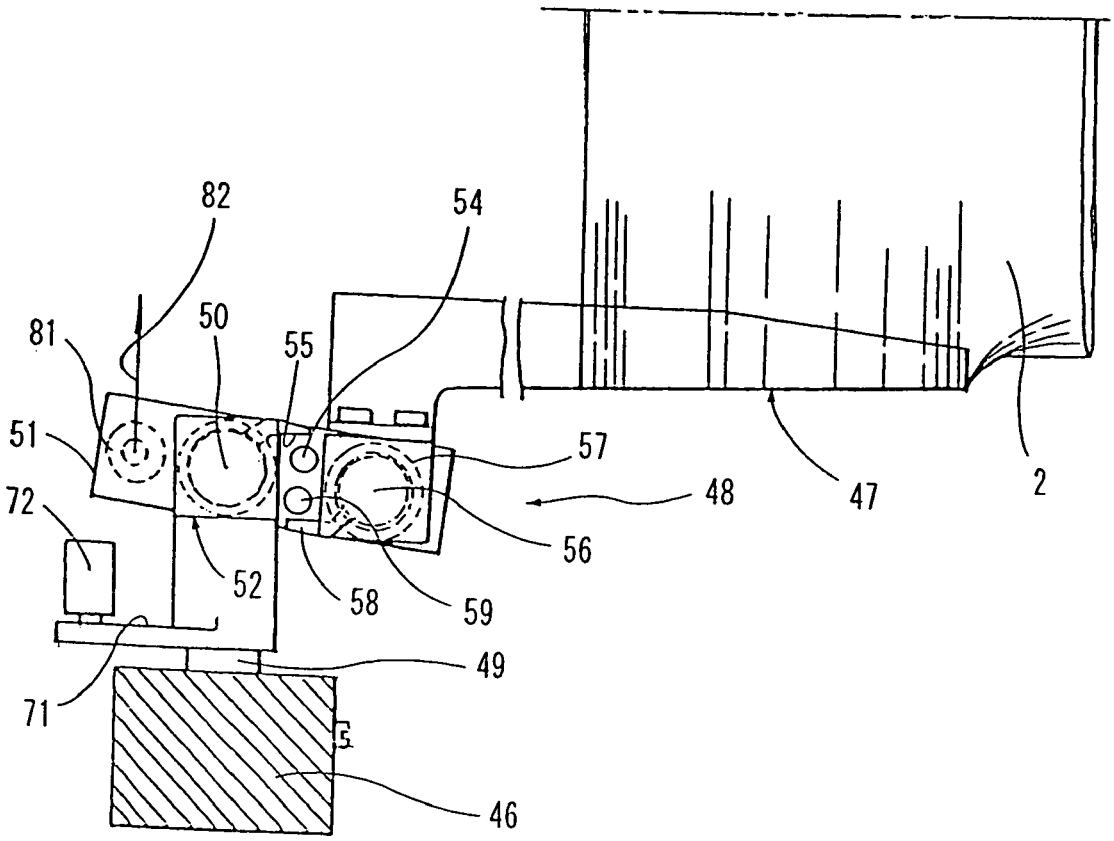
FIG. 8 is a descriptive diagram of the operation of the shock-absorbing mechanism.

More specifically, as shown in FIG. 7 and FIG. 8, a block 70 supporting and fixing the core axle 50 is supported on the pin 49 projecting from each frame 46, and a lever 71 for holding a sliding wheel 72 is provided on each block 70. Therefore, by operating the sliding wheels 72 by means of a guide similar to the front side rails 65 and the rear side rails 66 described in FIG. 11, it is possible to cause the opening and closing bars 47 in FIG. 9 to change in the upward and downward direction, in harmony with the opening and closing movement of the lower groove-shaped member 35.

In FIG. 9, inching control is performed in such a manner that the feed pitch of each bag 2 coincides with the back and forth movement cycle of the beak-shaped hopper 15. More specifically, a sensor 68 for halting the front end of the bag 2 in a predetermined position is disposed in the feed path of the adhesive tapes 62. A gear wheel 73 is provided, via a one-way clutch, between the reel 63 and the supporting axle 63*a*, while a toothed rack 75 connected to an air cylinder 74 causing the reel 63 to perform inching rotation, in the anti-clockwise direction only, via the gear wheel 73. Therefore, each time the beak-shaped hopper 15 peels off a bag 2 from the tapes 62, an operating device 77, such as an electromagnetic switching valve, is operated by means of a signal from the control device 76 connected to the sensor 68, and the reel performs an inching rotation by means of the cylinder 74.

In FIG. 2, the pushing bar 21 transfers an item to be packaged 4 onto a waiting station 31, immediately before the waiting station 31 and the hopper 15 are moved in unison. The beak-shaped hopper 15 then starts to advance, together with the station 31 on which the item to be packaged 4 is mounted, and the bag 2 is conveyed onto the top of the fixed base 9 in FIG. 1. Immediately after this, a pair of touch bars 80 on either side of the main travel path as illustrated in FIG. 5 are respectively rotated, pushing a pin roller 81 of the shock-absorbing mechanism 48, and the respective opening and closing bars 47 are opened to either side, thereby tensioning the opening of the bag. More specifically, a pressing force is applied to the pin roller 81 shown in FIG.

Figure 12:
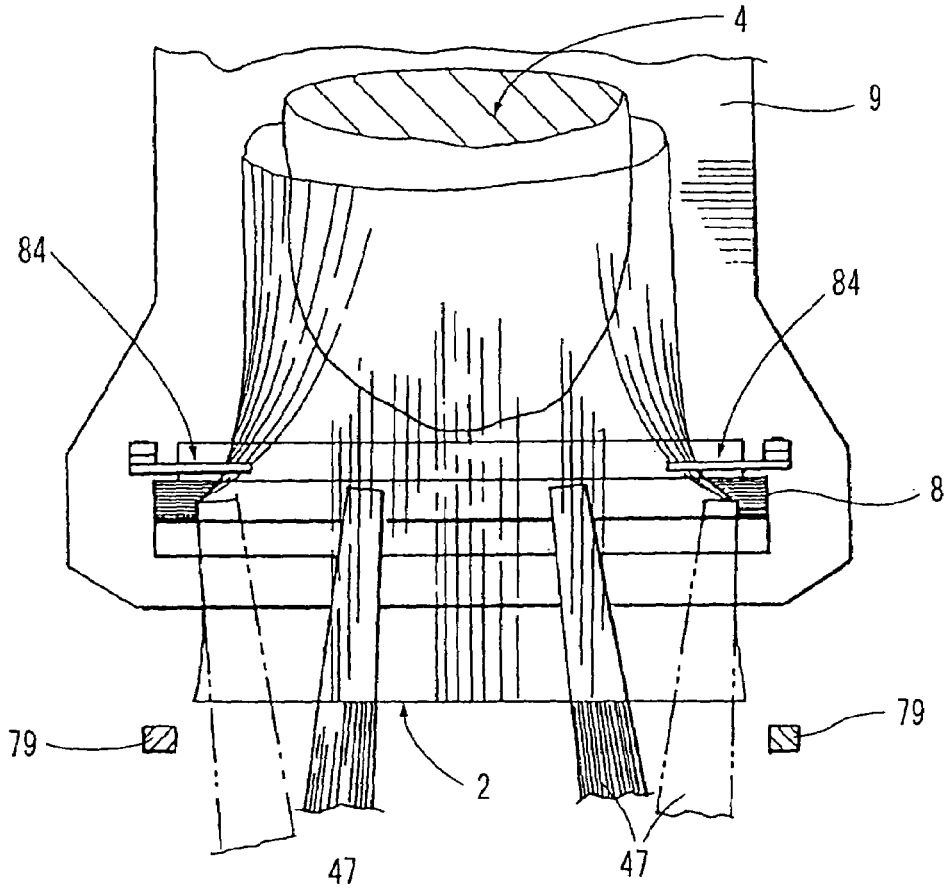
FIG. 12 is a descriptive diagram of the tensioning of a bag by means of the opening and closing bars.

6 or 7, and due to the force acting on the pin roller 81 in the direction of arrow 82 in FIG. 8, the edges of the opening of the bag 2 are tensioned while experiencing the shock-absorbing effect of the springs 57. If the beak-shaped hopper 15 advances without taking up a bag, then when the opening and closing bars 47 open up, since no bag 2 is present, as illustrated in FIG. 12, the opening and closing bars 47 are detected by the sensors 79 disposed on either side. Therefore, the tensioning effect of the opening and closing bars 47 confirms the presence of a bag 2, and if the presence of a bag 2 is confirmed, then as shown in FIG. 13, the pushing bar 21 conveys the item to be packaged 4 inside the bag 2, via the beak-shaped hopper 15.

Figure 13:
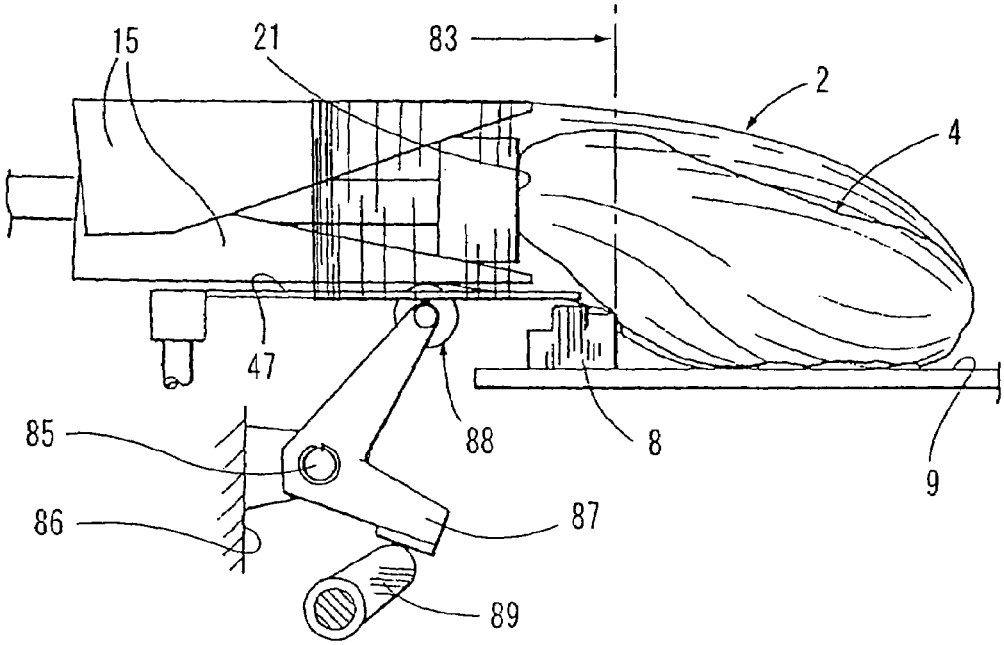
FIG. 13 is a descriptive diagram of the conveyance of an item to be packaged into a bag.

As shown in FIG. 13, when the item to be packaged 4 is conveyed into the bag 2, a sliding wheel type frictional element 88 on the front end of a swinging member 87 fixed to a base 86 about a pin 85 forming an axle, is pressed against the lower face of the bag 2, due to the pressing force of a rotating cam 89. This is in order to prevent the bag 2 from falling off from the beak-shaped hopper 15, due to the momentum of the item to be packaged 4 which is pushed into the bag 2 by the pushing bar 21. At the same time, this is also in order that, while applying a stretching tension to the bag 2, the front end face of the pushing bar 21 is stopped by the inner side face 83 of the sealing platform 8, and the end of the item to be packaged 4 is caused to halt at the edge of the inner side face 83 of the sealing platform. By means of this process, surplus space inside the bag 2 is eliminated.

Thereupon, the upper and lower rear side rails 66 in FIG. 11 are brought together, the front ends of the upper and lower groove-shaped members 34, 35 are closed and then removed from the bag 2, and the beak-shaped hopper 15 and the waiting station 31 are withdrawn in unison to the starting station 20 shown in FIG. 2. Immediately after this, the opening and closing bars 47 are separated again towards either side, inside the bag 2 in FIG. 12, thereby tensioning the mouth of the bag 2, while at the same time, a pair of clamp mechanisms 84 pushes either side of the bag 2 towards the vicinity of the sealing platform 8. The opening and closing bars 47 are retreated to the starting station 20, along the path of the beak-shaped hopper, and preparations for subsequent conveyance of a bag 2 and an item to be packaged 4 are made, with respect to the arrival of the next pressure resistant chamber 10.

The operation of the respective constituent elements is described with respect to FIG. 14. When the beak-shaped hopper 15 and the opening and closing bars 47 are respectively waiting at standby (S1) at the starting station 20, the pushing bar 21 has already supplied an item to be packaged 4 to the standby station 31 belonging to that beak-shaped hopper 15 (S2).

Thereupon, the beak-shaped hopper 15 and the opening and closing bars 47 are advanced in unison in the direction of the vacuum packaging mechanism (S3), but during this advance, a bag 2 is taken up from the tapes 62 (S4), and this bag is conveyed into the pressure resistant chamber and halted (S5). Here, the pushing bar 21 follows the item to be packaged (S6), and halts (S7). Firstly, the opening and closing bars 47 are opened up, and a primary confirmation of the opening of the bag is carried out (S8). When the confirmation of the bag 2 is completed, the pushing bar 21 conveys the item to be packaged 4 inside the bag (S9). The pushing bar 21 is withdrawn towards the starting station (S10). Subsequently, the beak-shaped hopper 15 is also withdrawn (S11), and as a final operation, the opening and closing bars 47 perform a secondary tensioning (S14) of the opening of the bag, and are then withdrawn (S13), whereupon one cycle is completed.

As described previously, when the opening and closing bars 47 in FIG. 12 are opened towards either side and the primary confirmation of the bag 2 is carried out (S8), if no bag 2 is present and either one of the opening and closing bars 47 make contact with the sensor 79, then a non-confirmation signal is issued in the bag detection performed by the opening and closing bars 47, and hence the pushing bar 21 is withdrawn (S15) without an item to be packaged being conveyed inside a bag. In this case, the opening and closing bars 47 perform a secondary tensioning operation (S14), the operation of the entire device is halted by the operation of the sensor 79, and the operation of the entire system reverts to an initial state.

In some cases in FIG. 14, it is not possible to detect a bag in the secondary tensioning operation (S14), despite the fact that the opening and closing bars 47 have performed the primary confirmation (S8) of the opening of the bag. This phenomenon may occur as a result of the bag 2 being withdrawn excessively due to the momentum of the item to be packaged when it is conveyed into the bag 2, after the first primary confirmation (S8). In cases of this kind, the sensor 79 activates in the secondary tensioning operation (S14), and a halt signal is issued to the entire device.

Figure 15:
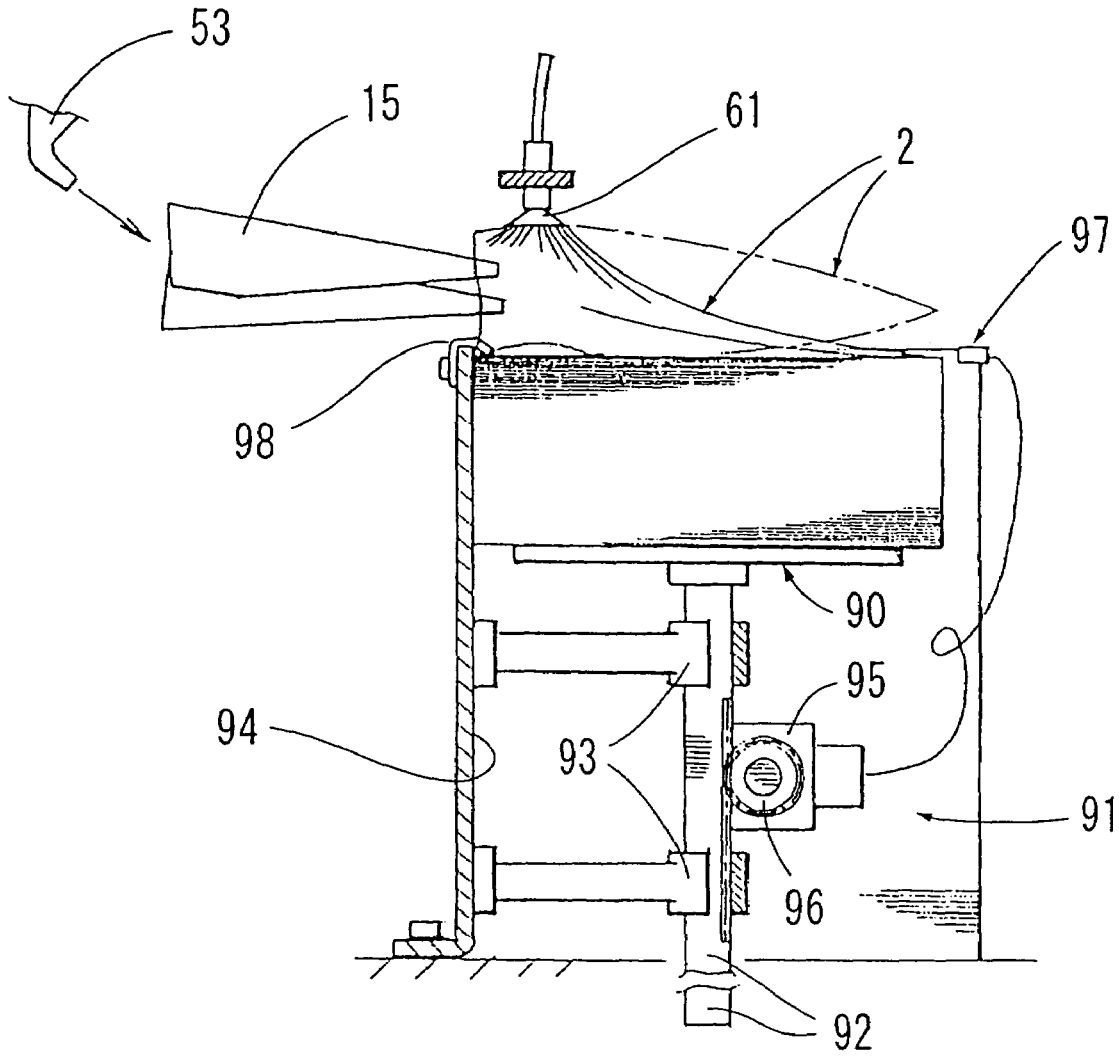
FIG. 15 is a side view of a bag stacking box.

FIG. 15 is a further embodiment of stacked bags, the difference lying in the fact that, whenever the edges of the opening of the uppermost bag 2 stacked in a vertical fashion on a loading plate 90 are opened up by means of the vacuum cups 61, the beak-shaped hopper 15 extends the edges of the opening of the bag 2 and picks off the bag 2, a composition being adopted wherein the loading plate 90 is gradually raised by a lifting mechanism 91, apart from which the action is no different from the operation performed with respect to the bags attached to tapes illustrated in FIG. 9.

More specifically, a lifting mechanism 91 supports a rack bar 92 that is integrated with the loading plate 90, on a sleeve 93. A pinion 96 driven by an electric motor 95 and fixed to a bag accommodating box 94 engages with the teeth of the rack bar 92, in addition to which the angle of rotation of the electric motor 95 is controlled by a sensor 97 which monitors the upper face of the bag 2. The upper face is picked up by the vacuum cups 61, while the lower face of the bag 2 is pressed by means of a hook-shaped member 98, and the bags 2 are successively picked off by the hopper 15, while applying air pressure to the interior of the bag by means of the air blower 53.

What is claimed is:

1. A packaging system, comprising:

means for causing a beak-shaped hopper, formed by a pair of upper and lower groove-shaped members, and a pair of opening and closing bars, to move back and forth in unison along a main travel path leading to a rotary vacuum packaging device;

means for extending and supporting an opening section of an uppermost packaging bag of packaging bags stacked in the main travel path, and conveying the bag into a pressure resistant chamber of the vacuum packaging device, by means of the back and forth movement of the beak-shaped hopper in the main travel path;

means for causing a waiting station to move following the conveyance movement of the beak-shaped hopper into a pressure resistant chamber;

means for detecting a resistance of the bag by opening the opening and closing bars towards both sides immediately after the bag has been conveyed into the pressure resistant chamber;

means for conveying a to-be-packaged item waiting on the waiting station, into the bag, via the beak-shaped hopper, by means of a pushing bar, if the resistance of the bag is detected by the opening and closing bars;

means for withdrawing the pushing bar, while leaving the item on the waiting station, when the resistance of the bag against the opening and closing bars is not detected; and means for detecting, by means of said sensor, movement of the opening and closing bars performing excessive opening due to the absence of a bag, when the edges of the opening of the bag are tensioned by further opening of the opening and closing bars, and for halting the operation of the entire device in accordance with this detection signal.

2. The packaging system according to claim 1, wherein a frictional element is disposed in the main travel path, and this frictional element is caused to make contact with a bag situated about the beak-shaped hopper advancing in the direction of the rotary vacuum packaging device, thereby limiting excessive slippage of the bag due to the pushing bar.

3. The packaging system according to claim 2, wherein the amount by which the pushing bar plunges into the bag is made to coincide with an inner side edge of a sealing platform of the pressure resistant chamber.

4. The packaging system according to claim 1, wherein air pressure is caused to act on the interior of the bag extended by the upper and lower groove-shaped members, through inside the groove shape, whereby the bag is conveyed into the pressure resistant chamber in an expanded state.

5. A packaging system, comprising:

means for causing a beak-shaped hopper, formed by a pair of upper and lower groove-shaped members, and a pair of opening and closing bars, to move back and forth in unison along a main travel path leading to a rotary vacuum packaging device;

means for extending and supporting an opening section of an uppermost packaging bag of packaging bags stacked in the main travel path, and conveying the bag into a pressure resistant chamber of the vacuum packaging device, by means of the back and forth movement of the beak-shaped hopper in the main travel path;

means for causing a waiting station to move following the conveyance movement of the beak-shaped hopper into a pressure resistant chamber;

means for detecting a resistance of the bag by opening the opening and closing bars towards both sides immediately after the bag has been conveyed into the pressure resistant chamber;

means for conveying a to-be-packaged item waiting on the waiting station, into the bag, via the beak-shaped hopper, by means of a pushing bar, if the resistance of the bag is detected by the opening and closing bars;

means for withdrawing the pushing bar, while leaving the item on the waiting station, when the resistance of the bag against the opening and closing bars is not detected;

wherein the beak-shaped hopper is removed from inside the bag, after the presence of the bag has been detected by the opening of the opening and closing bars to either side, and the edges of the opening of the bag, tensioned by further opening of the opening and closing bars, are held in the vicinity of a sealing platform inside the pressure resistant chamber, by means of a pair of clamping mechanisms provided on both sides of the pressure resistant chamber; and a means for detecting, by means of said sensor, movement of the opening and closing bars performing excessive opening due to the absence of a bag, when the edges of the opening of the bag are tensioned by further opening of the opening and closing bars, and for halting the operation of the entire device in accordance with this detection signal.

6. The packaging system according to claim 5, wherein a frictional element is disposed in the main travel path, and this frictional element is caused to make contact with a bag situated about the beak-shaped hopper advancing in the direction of the rotary vacuum packaging device, thereby limiting excessive slippage of the bag due to the pushing bar.

7. The packaging system according to claim 6, wherein the amount by which the pushing bar plunges into the bag is made to coincide with the inner side edge of the sealing platform of the pressure resistant chamber.

8. The packaging system according to claim 5, wherein air pressure is caused to act on the interior of the bag extended by the upper and lower groove-shaped members, through inside the groove shape, whereby the bag is conveyed into the pressure resistant chamber in an expanded state.

* * * * *